US008430391B1

(12) United States Patent
Park et al.

(10) Patent No.: US 8,430,391 B1
(45) Date of Patent: Apr. 30, 2013

(54) SLIDING TANDEM MEDIA FEEDER IN A PRINTER

(75) Inventors: Daniel Clark Park, West Linn, OR (US); Timothy Carlysle Shaw, Sammamish, WA (US); Michael John Janicki, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/272,996

(22) Filed: Oct. 13, 2011

(51) Int. Cl.
*B65H 3/44* (2006.01)

(52) U.S. Cl.
USPC ..... 271/9.12; 271/9.02; 271/9.03; 271/126

(58) Field of Classification Search ..... 271/9.12, 271/9.02, 9.03, 126
See application file for complete search history.

(56) References Cited

U.S. PATENT DOCUMENTS 5,085,421 A * 2/1992 Sellers ..... 271/157
5,102,112 A * 4/1992 Takahashi ..... 271/127
5,150,893 A 9/1992 Uno et al.
5,163,670 A * 11/1992 Sellers et al. ..... 271/157
5,195,734 A * 3/1993 Tanabe ..... 271/9.03
5,335,903 A 8/1994 Martin et al.
5,971,387 A 10/1999 Kita
6,123,329 A 9/2000 Sato et al.
6,332,609 B1 12/2001 Arakawa
6,547,234 B1 4/2003 Quesnel
7,654,514 B2 2/2010 Milillo
7,819,520 B2 * 10/2010 Takagi ..... 347/108
7,823,869 B2 11/2010 Ise
7,866,654 B2 1/2011 Ohno

* cited by examiner

*Primary Examiner* — Gerald McClain
(74) *Attorney, Agent, or Firm* — Maginot, Moore & Beck, LLP

(57) ABSTRACT

In a tandem media supply, two vertical stacks of media sheets are stored. The first stack is positioned on a lift plate that rises as top sheets are removed from the stack of media. When the first stack is exhausted, the second stack is moved by an actuator towards a position where the lift plate was loaded with the first stack of media sheets. Movement of the second stack displaces a biased gate to decouple the lift plate from a drive member that elevated the lift plate. The lift plate drops under the effect of gravity to a position where the second stack of media sheets moves onto the lift plate. Once the second stack is on the lift plate, a biasing force returns the biased gate to a position that enables the drive member to elevate the lift plate.

4 Claims, 8 Drawing Sheets

SLIDING TANDEM MEDIA FEEDER IN A PRINTER

TECHNICAL FIELD

This disclosure relates generally to devices for managing print media in a printer and, more particularly, to devices for handling stacks of media sheets in a printer.

BACKGROUND

Many imaging devices, such as printers, photocopiers, and multi-function imaging devices, store a supply of media sheets, such as paper sheets, in one or more internal trays. The sheets are vertically stacked within the trays by a user or service technician. Media trays are sized and configured to hold hundreds or thousands of sheets.

Some imaging devices extract media sheets from a stack in the media tray starting from the top sheet in the stack. A media feeder uses various moving members, such as rollers, to extract the top sheet from the stack as needed to supply the imaging device. As sheets are removed from the stack, a lift plate positioned under the stack of sheets raises the remaining sheets in the tray so the top sheet in the media feeder remains ready for removal from the stack. In some printers, an electric motor raises the lift plate and media stack as the media feeder extracts sheets from the media stack.

In a tandem media supply configuration, a single media supply tray holds two stacks of media sheets that are positioned next to each other. One of the stacks is placed on the lift plate, while the second stack is held in reserve. When the media feeder extracts all of the media sheets from the stack on the lift plate, an actuator returns the lift plate to an area adjacent to the reserve stack so another actuator can slide the reserve stack of media sheets onto the lift plate.

Tandem paper supplies efficiently use space within an imaging device and enable the media supply to store larger quantities of media sheets than comparable trays that hold only a single stack. The tandem media trays are, however, typically more mechanically complex since a tandem media tray moves two different media stacks in different directions during operation. Existing tandem media supplies either use three separate electric motors to move the media stacks and feed media, or use two motors with a series of electromagnetic clutches to move the media stacks and feed media. The existing media supplies consume electricity during operation, and complex mechanical assemblies can suffer from reliability issues during operation. Improved tandem media supplies that supply media sheets to the imaging device with better reliability and lower energy usage would be beneficial.

SUMMARY

In one embodiment, a tandem media supply has been developed. The tandem media supply includes a housing having a volume that is configured to hold a plurality of media sheets in a vertical stack, a lift plate positioned in the housing and configured to elevate from a first position within the volume of the housing to a second position in the volume of the housing, an actuator configured to move the vertical stack of media sheets onto the lift plate when the lift plate is at the first position within the volume, and a gate configured to move from a first position to a second position. The gate is configured to enable the lift plate to rise to the second position within the volume of the housing when the gate is in the first position and to enable the lift plate to return to the first position within the volume of the housing when the gate is in the second position.

In another embodiment, a tandem media supply has been developed. The tandem media supply includes a housing having a volume that is configured to hold a first vertical stack of media sheets and a second vertical stack of media sheets, a media feeder configured to extract a media sheet from a top of the first stack of media sheets, a lift plate configured to elevate within the volume of the housing, an actuator, a mechanism that operatively connects the actuator to the lift plate, the actuator being configured to operate the mechanism to elevate the lift plate in response to the media feed extracting media sheets from the first media stack, a second actuator configured to move the second vertical stack of media sheets onto the lift plate when the lift plate is at a first location in the volume of the housing, and a gate configured to move from a first position to a second position. The gate is configured to enable the actuator to elevate the lift plate within the volume of the housing when the gate is in the first position and to enable the lift plate to return to the first location within the volume of the housing when the gate is in the second position.

In another embodiment, a method for supplying media sheets in an imaging device has been developed. The method includes operating a first actuator operatively connected to a lift plate positioned within a volume of a housing to elevate the lift plate in response to top sheets of a first vertical stack of media sheets on the lift plate being extracted from the first vertical stack of media sheets, operating a second actuator to move a second vertical stack of media sheets from a first location in the volume of the housing toward a second location in the volume of the housing in response to a last sheet of media being extracted from the first vertical stack of media sheets, releasing the lift plate from the first actuator to enable the lift plate to drop to the second location in the volume of the housing, and continuing to operate the second actuator to move the second vertical stack of media sheets onto the lift plate at the second location.

In another embodiment, a tandem media sheet supply for an imaging device has been developed. The tandem media sheet supply includes a housing having a volume that is configured with a first portion and a second portion, each portion of the volume in the housing being configured to hold a vertical stack of media sheets in the housing, a gate assembly located between the first portion and the second portion of the volume in the housing and an actuator configured to move a first vertical stack of media sheets from the first portion of the volume in the housing to the second portion of the volume in the housing. The gate assembly includes a first gate configured to engage the first vertical stack of media sheets in the first portion of the volume, a second gate mechanically connected to the first gate, the first gate and second gate being configured to move between a first position and a second position, and a biasing member configured to bias the first gate and second gate into the first position. The movement of the first vertical stack of media sheets displaces the first gate and the second gate from the first position to the second position. The first gate and second gate in the second position enable the first vertical stack of media sheets to move from the first portion of the volume in the housing to the second portion of the volume in the housing. The biasing member is configured to move the first gate and the second gate to the first position in response to the actuator moving the first vertical stack of media sheets to the second portion of the volume, and the second gate in the first position is configured to hold the first vertical stack of media sheets in the second portion of the volume.

DETAILED DESCRIPTION

Figure 1:
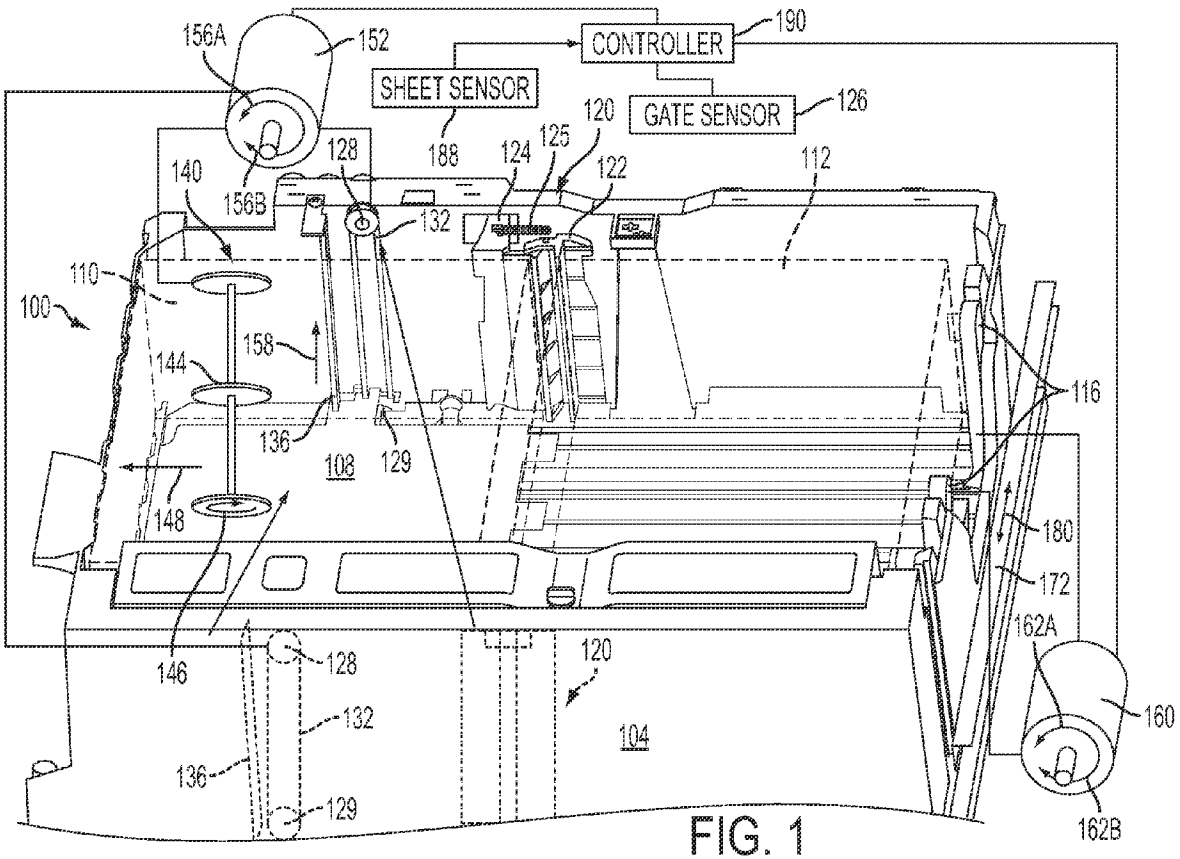
FIG. 1 is a perspective view of a tandem media supply holding two stacks of media sheets.

For a general understanding of the environment for the devices and methods disclosed herein as well as the details for the devices and methods, reference is made to the drawings. In the drawings, like reference numerals designate like elements.

In this document, the term "printer" refers to any device that is configured to form images on a print medium using a marking agent. As used herein, the term "media sheet" refers to a single sheet of material that passes through a printer. The printer forms an image on one or both sides of the media sheet in a simplex or duplex print mode, respectively. A common form of media sheet is a paper sheet in various sizes including letter and A4 sized paper sheets. A stack of media sheets includes a plurality of media sheets arranged vertically on top of one another.

As used herein, the term "mechanism" refers to any mechanical coupling between an actuator and a movable member that transfers mechanical force from the actuator to the member. When activated, the actuator generates a mechanical force that transfers through the mechanism to move the member. Some mechanisms also include a locking member that holds the movable member in a fixed position when the actuator is not moving the movable member. Either or both of the actuator and movable member disengage from the mechanism whenever the actuator, one or more components in the mechanism, or the movable member are configured to decouple the movement of the actuator from the movement of the movable member. As described in more detail below, a lift plate is an example of a movable member that selectively engages an actuator through a mechanical mechanism to enable the actuator to elevate the lift plate in the media supply. When either the actuator or lift plate decouples from the mechanism, the lift plate is free to move under an external force such as gravity.

FIG. 1 depicts a tandem media supply 100 that holds two vertical stacks of media sheets. Media supply 100 is configured for use in various sheet-fed printers including xerographic and inkjet printers. The media supply 100 includes a housing 104 that is configured to hold two vertical stacks of media sheets 110 and 112, also referred to as the feed stack 110 and reserve stack 112. The interior of the housing 104 forms a volume that holds the two stacks of media sheets 110 and 112 at two separate locations in the tandem arrangement shown in FIG. 1. The housing 104 also holds a lift plate 108, slideable arms 116, and a gate assembly 120. An exemplary media feeder 140 includes sheet rollers 144 that are configured to contact the top sheet in the media sheet stack 110. An actuator 152 is operatively connected to the lift plate 108 and the media feeder 140. A second actuator 160 is operative connected to the slideable arms 116. An electronic controller 190 selectively activates and deactivates the actuators 152 and 160, and monitors the position of the gate assembly 120 using a gate sensor 126.

Figure 7:
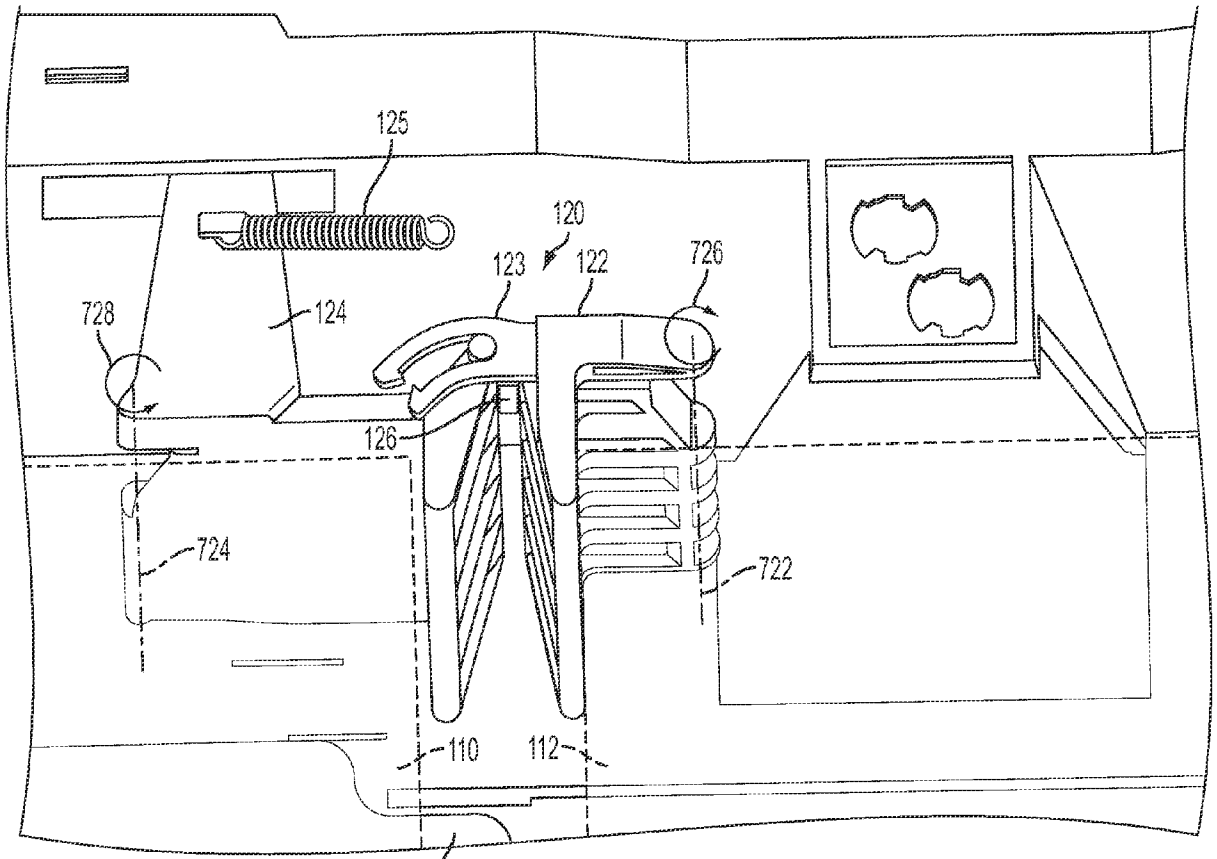
FIG. 7 is a perspective view of a media stack gate in the tandem media supply depicted in FIG. 1.

FIG. 7 depicts the gate assembly 120 in the configuration of FIG. 1 in more detail. The gate assembly 120 includes a reserve stack gate 122 that engages a feed stack gate 124. In the configuration of FIG. 1, the reserve stack gate 122 engages the reserve media stack 112 and holds media sheets in the reserve media stack 112 in place during printing operations. The feed stack gate 124 engages the feed stack 110 and holds the feed stack 110 in place on the lift plate 108 so that the media sheets in the feed stack 110 are in position to be extracted during print jobs. The feed stack gate 124 prevents lateral shifting or sliding of the feed stack 110 within the housing 104 during printing operations. In the configuration of FIG. 1 and FIG. 7, the feed stack gate 124 is biased by a spring 125 into a first position where the gate engages the feed stack 110. In the first position, the feed stack gate 124 also urges the reserve stack gate 122 into engagement with the reserve stack 112. In some embodiments, a second gate assembly is positioned across from the gate assembly 120 on the second end of the media stacks 110 and 112 in the housing 104.

Figure 2:
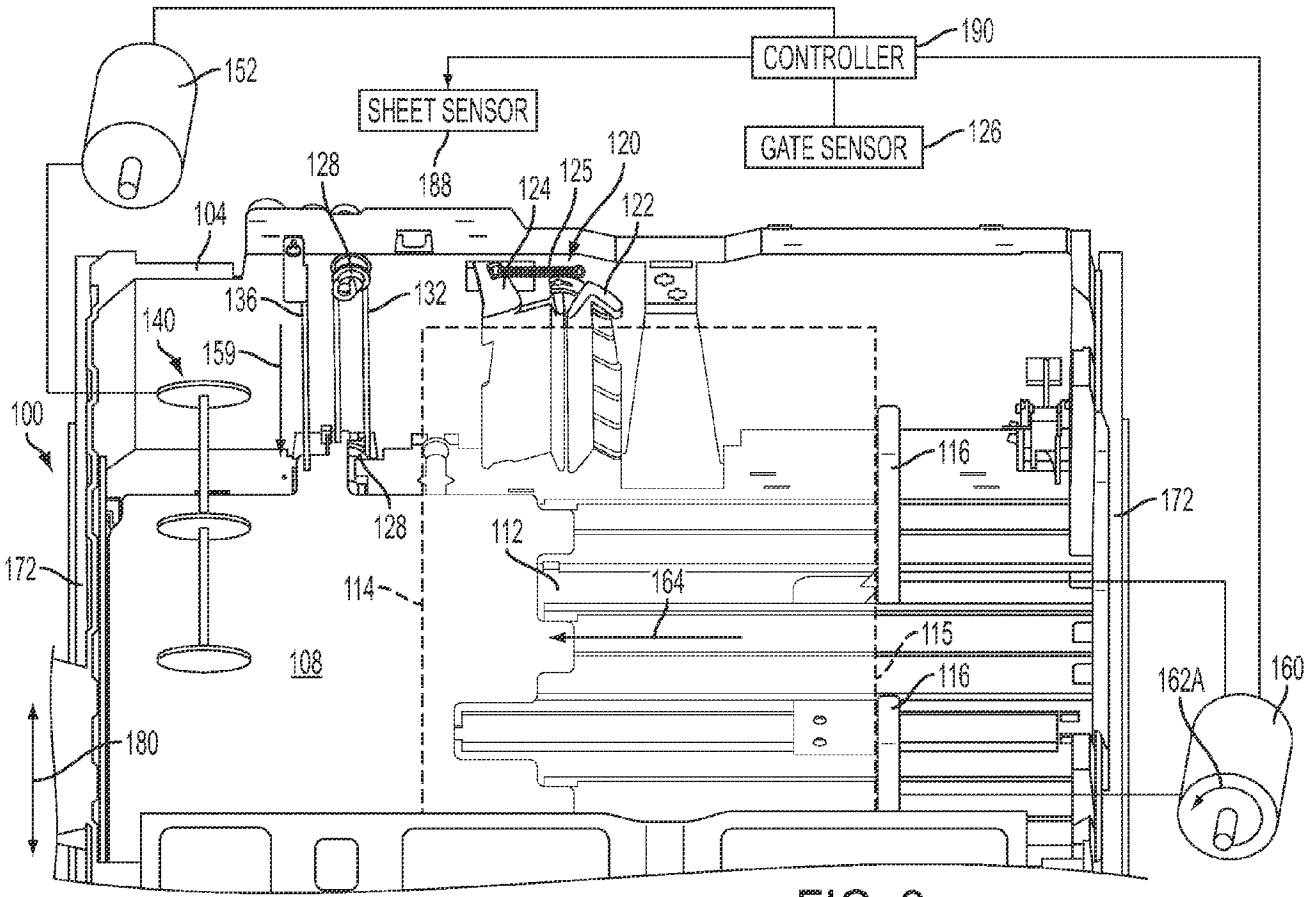
FIG. 2 is a perspective view of the tandem media supply of FIG. 1 as a reserve stack of media sheets moves onto a lift plate.
Figure 8:
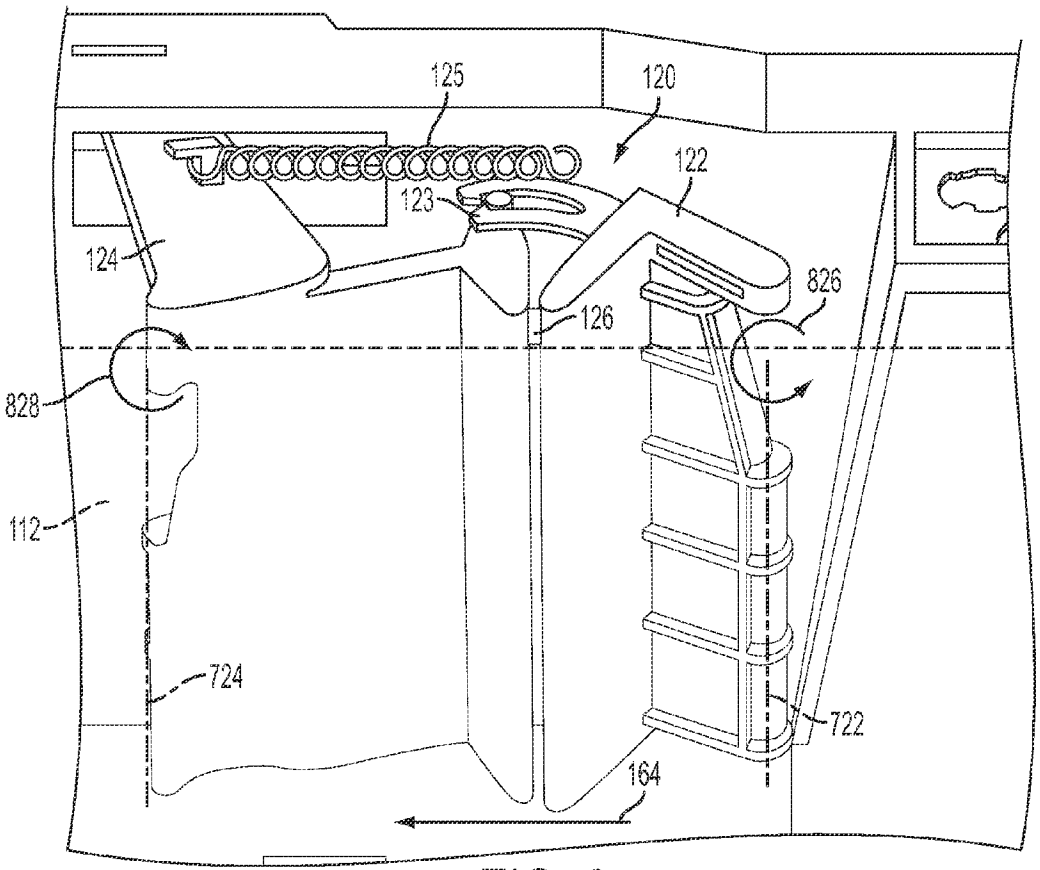
FIG. 8 is a perspective view of the media stack gate in the tandem media supply depicted in FIG. 2.

The reserve stack gate 122 is configured to rotate from the position depicted in FIG. 7 along a rotational axis 722 in direction 726. A linking arm 123 on the reserve stack gate 122 engages the feed stack gate 124 and rotates the feed stack gate 124 around an axis 724 in direction 728. FIG. 2 and FIG. 8 depict the reserve stack gate 122 and feed stack gate 124 after rotating in directions 726 and 728, respectively, into a second position as the reserve media stack 112 slides onto the lift plate 108. Rotation of the feed stack gate 124 to the second position stretches the spring 125. In the configuration of FIG. 8, the reserve media stack 112 displaces the reserve stack gate 122 and feed stack gate 124 into the second position as the reserve media stack 112 slides in direction 164. When a trailing edge 115 of the reserve media stack 112 moves past the feed stack gate 124 in direction 164, the return force of the spring 125 rotates the feed stack gate 124 in direction 828 and the reserve stack gate 122 in direction 826 to return to the first position depicted in FIG. 7. The gate assembly 120 does not require an electromechanical actuator to be connected to the reserve stack gate 122 or the feed stack gate 124 to enable movement between the first and second position. Instead, the gate assembly 120 remains in the first position depicted in FIG. 7 until the movement of the reserve media stack 112 displaces the gate assembly 120 into the configuration of FIG. 8, and the spring 125 returns the gate assembly 120 to the configuration of FIG. 7 in response to the reserve stack 112 moving past the gate assembly 120.

The gate assembly 120 includes a gate sensor 126 that generates a signal corresponding to the position of the gate assembly 120. In one embodiment, the sensor 126 is an optical sensor that directs a beam of light onto a photodetector. In the configuration of FIG. 7, the photodetector receives the light, and the sensor 126 generates a signal indicating that the gate assembly 120 is in the first position. Once the gate assembly moves out of the first position, the movement of the linking arm 123 blocks the light source, and the sensor 126 generates a second signal indicating that the gate assembly 120 is not in the first position depicted in FIG. 7. Various other configurations of the gate sensor 126 include electrical contact sensors or switches that indicate the position of the gate assembly 120. The controller 190 receives signals generated by the gate sensor 126. During a loading operation in which the reserve stack 112 slides past the gate assembly 120, the controller monitors the signals from the sensor 126 until the gate assembly returns to the position of FIG. 7 and the sensor 126 indicates the reserve media stack 112 is position on the lift plate 108. The gate assembly 120 can move out of the first position at other times during operation due to improperly loaded stacks of media sheets or if incorrectly sized media sheets are placed in the media supply 100. The controller 190 generates a paper jam error or other indication to an operator to correct the configuration of the media sheet stacks 110 and 112.

Referring again to FIG. 1, actuators 152 and 160 are embodied as electrical motors in the media supply 100. Each of the actuators 152 and 160 rotates in one of two directions in response to an electrical current. The controller 190 activates and deactivates each of the actuators 152 and 160, and selects a direction of rotation of each actuator either through a mechanical or electrical control for each actuator.

The controller 190 may be implemented with general or specialized programmable processors that execute programmed instructions, for example, operation of the actuators and media feeder in the media supply 190. The instructions and data required to perform the programmed functions may be stored in memory associated with the processors or controllers. The processors, their memories, and interface circuitry configure the controllers to perform the processes, described more fully below, that enable the media supply 100 to control the supply of media sheets to various other subsystems in the printer. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Additionally, the circuits described herein may be implemented with a combination of processors, ASICs, discrete components, or VLSI circuits. In some embodiments, the controller 190 operates various other subsystems in the printer in addition to the media supply 100.

During a printing operation, the sheet rollers 144 rotate in direction 146 and the top media sheet on the media stack 110 moves out of the media supply 100 in direction 148 and into a media path in the printer (not shown). The media feeder 140 is merely an example of a feeding device that extracts media sheets from a vertical media sheet stack when operated by an actuator. Various other media feeder embodiments can be used with the media supply 100 and actuator 152. The lift plate 108 supports and elevates the media stack 110 in direction 158 as media sheets are extracted from the media stack 110. In various embodiments the lift plate is formed from a metal sheet or rigid plastic that is configured to support the weight of a full stack of media sheets held in the media supply 100. The lift plate 108 maintains the elevated position of the media stack 110 in the housing 104 to enable the sheets rollers 144 in the media feeder 140 to remain in contact with the top sheet in the media stack 110 as the media feeder extracts sheets from the media stack 110.

In the media supply 100, a single actuator 152 elevates the lift plate 108 and rotates the rollers 144 in the media feeder 140. The actuator 152 is configured to rotate in two directions 156A and 156B. In the example of FIG. 1, the actuator 152 rotates in direction 156A to elevate the lift plate 108. As the actuator 152 rotates in direction 156A, a gear assembly, depicted below in FIG. 3 and FIG. 4, rotates two sets of drive wheels 128 and 129. Each set of drive wheels 128 and 129 rotates one of two endless belts 132 that are operatively connected to the lift plate 108 on two sides of the housing 104. The gear assembly, drive wheels 128 and 129, and two endless belts 132 form a mechanism between the actuator 152 and the lift plate 108. As the actuator 152 rotates in direction 156A, the lift plate 108 rises within the housing 104 along guide rails 136, and the media feeder 140 remains stationary. A one-way mechanical connection such as a ratchet, sprag clutch, or freewheel clutch disengages the actuator 152 from the media feeder 140 when the actuator 152 rotates in direction 156A. The one-way mechanical connection in the mechanism maintains the elevated position of the lift plate 108 in the housing 104 when the actuator 152 is deactivated and when the actuator 152 rotates in direction 156B.

In the media supply 100, the actuator 152 rotates in direction 156B to rotate the rollers 144 in the media feeder 140. The rollers 144 contact a media sheet at the top of the media stack 110 and the top media sheet slides out of the media supply 100 in direction 148. A second one-way mechanical connection between the actuator 152 and the lift plate 108 prevents the lift plate 108 from moving as the actuator 152 rotates in direction 156B. During operation, the controller 190 selectively rotates the actuator 152 in both directions 156A and 156B to elevate the lift plate 108 and media sheet stack 110 into engagement with the media feeder 140, and to extract media sheets from the media sheet stack 110. A sheet sensor 188 identifies when a media sheet is extracted from the media stack 110. Various embodiments of the sheet sensor 188 include a relay switch that closes or opens when a media sheet contacts the sheet sensor 188, or an optical sensor that detects light reflected from the media sheet.

The media stack 110 on the lift plate 108 provides media sheets to the media feeder 140 until the media feeder 140 extracts the last media sheet and exhausts the media stack 110. In the tandem media supply 100, the second media stack 112 is positioned in a second location in the housing 104 and the media supply 100 moves the second media stack 112 onto the lift plate 108 to enable the media feeder 140 to begin extracting media sheets from the second media stack 112. At the time that the first media stack 110 is exhausted, the lift plate 108 is located at a maximum elevated position in the housing 104 after the actuator 152 elevates the lift plate 108 and first media stack 110 in direction 158. The lift plate 108 returns to the base of the housing 104 without the need of an actuator to enable the second media stack 112 to move onto the lift plate 108.

FIG. 2 depicts the media supply 100 as the second media stack 112 slides onto the lift plate 108. To slide the second media sheet stack 112 onto the lift plate 108, the controller 190 activates the actuator 160 to rotate in direction 162A. The actuator 160 moves the slideable arms 116 in direction 164, and the slideable arms 116 push the reserve media sheet stack 112 onto the lift plate 108. The controller 190 operates the actuator 160 in the reverse direction 162B to return the slideable arms 116 to the position depicted in FIG. 1 once the second media sheet stack 112 is loaded on the lift plate 108.

In FIG. 2, the lift plate 108 is depicted in the lowest operating position within the housing 104 that enables the second media stack 112 to slide onto the lift plate 108. When the media stack 112 begins to move in direction 164, the lift plate is still in the elevated position after exhaustion of the first media stack 110. As the leading edge 114 of the second media stack 112 moves in direction 164, the leading edge of the media stack engages the reserve stack gate 122 in the gate assembly 120. The media stack 112 pushes against the reserve stack gate 122, and the reserve stack gate 122 rotates into the second position depicted in FIG. 2 as the reserve media stack 112 slides in direction 164. The reserve stack gate 122 rotates the feed stack gate 124 via the linkage arm 123 as the reserve stack gate 122 rotates. Thus, the movement of the reserve media stack 112 displaces both the reserve stack gate 122 and feed stack gate 124. As described in more detail below in FIG. 3 and FIG. 4, the displacement of the feed stack gate 124 disengages a mechanism that holds the lift plate 108 in the elevated position. The lift plate 108 descends to the base of the housing 104 in direction 159 under the force of gravity before the second media stack 112 moves onto the lift plate 108. The media supply 100 does not require an electrical actuator or electromagnetic clutch device to lower the lift plate 108. The controller 190 operates the actuator 160 to move the second media stack 112 in direction 164, but does not generate any other control signals or operate any other electromechanical components in the media supply 100 to lower the lift plate 108.

Figure 3:
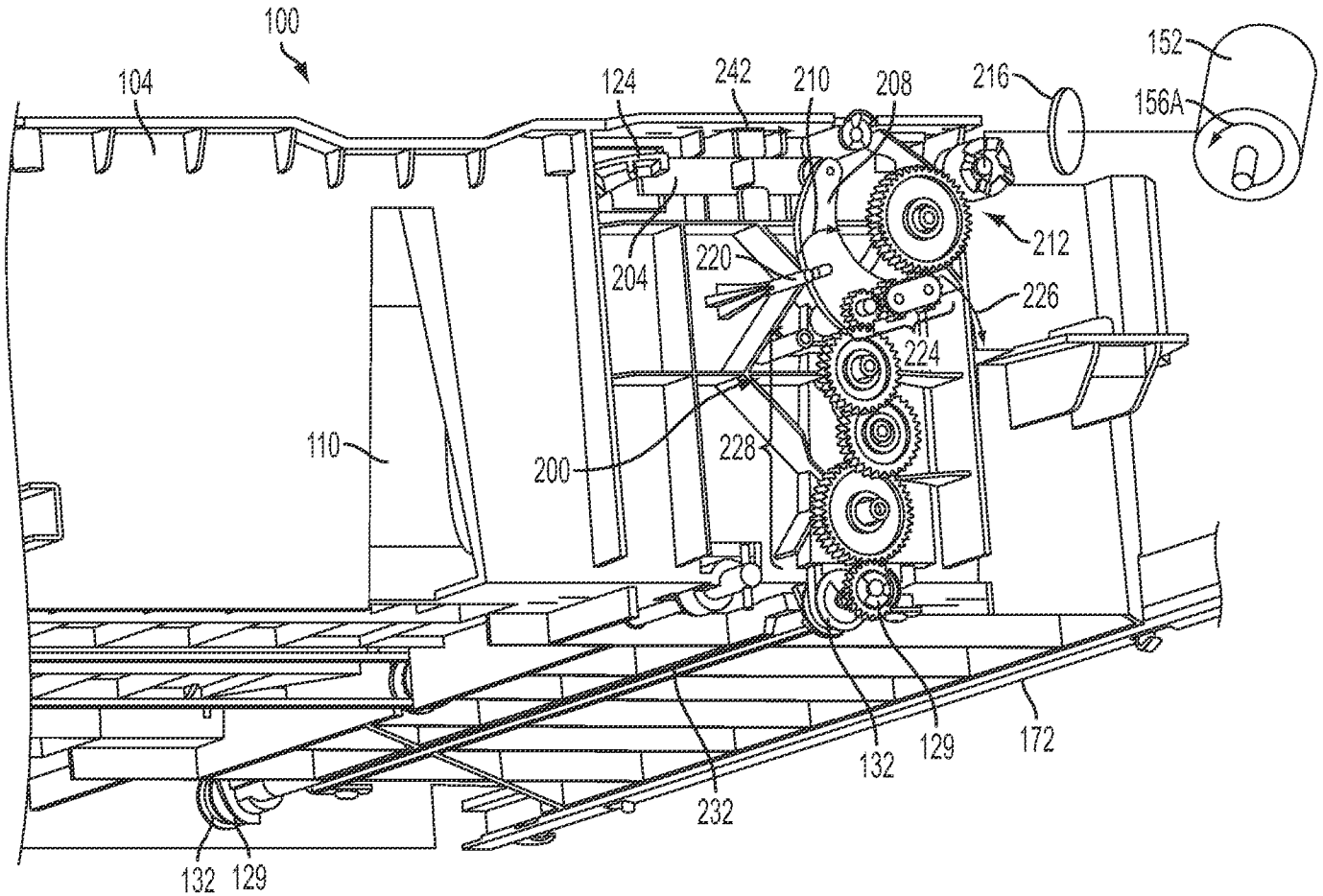
FIG. 3 is a perspective view of an exterior side of the tandem media supply of FIG. 1.

FIG. 3 depicts an external view of the media supply 100 when the media supply 100 holds two media stacks as depicted in FIG. 1. FIG. 3 depicts a mechanism 200 that mechanically connects the actuator 152 to the lift plate 108 to enable the actuator 152 to elevate the lift plate 108 in the housing 104. In the configuration of FIG. 3, the mechanism 200 also holds the lift plate 108 in elevated positions within the housing 104 as the media feeder 140 extracts media sheets from the media stack 110.

The mechanism 200 includes a one-way mechanical clutch 216, drive gears 212, release linkage 204, pivoting release arm 208, transmission gears 224, and intermediate gears 228. The mechanism 200 engages one of the drive wheels 129 that drives the belt 132. In the supply system 100, a drive shaft 232 links drive wheels 129 on either side of the housing 104, and the mechanism 200 is mechanically connected to both drive belts 132. In the configuration of FIG. 3, the pivoting release arm 208 urges the transmission gears 224 into engagement with the drive gears 212. A spring 220 biases the release arm 208 and transmission gears 224 into engagement with the drive gears 212 in the configuration of FIG. 3. The specific number and arrangement of gears depicted in the mechanism 200 exemplifies one mechanism embodiment, but alternative mechanism arrangements include different numbers and sizes of gears, and can also include other moving members including belts and rotating shafts that transfer mechanical force from the actuator to the lift plate.

During a printing operation, the controller 190 activates the actuator 152 to rotate in direction 156A to elevate the lift plate 108. The one-way mechanical clutch 216 engages the drive gears 212 when the actuator 152 rotates in direction 156. The drive gears 212 rotate and drive, in turn, the transmission gears 224, intermediate gears 228, drive wheels 128 and 129, and the drive belts 132 that move the lift plate 108 and media stack 110 within the housing 104. The exemplary embodiment of FIG. 3 implements the one-way mechanical clutch 216 with a ratchet, sprag clutch, freewheel clutch, roller clutch, or other appropriate mechanical connection. The one-way clutch 216 does not require an electrical current to operate and is not operatively connected to the controller 190. When the actuator 152 is deactivated or when the actuator 152 rotates in direction 156B to operate the media feeder 140, the one-way clutch 216 locks in position. In FIG. 3, the drive gears 212, transmission gears 224, intermediate gears 228, and drive wheels 129 are all engaged with the one-way clutch 216. Consequently, when the one-way clutch 216 locks in place, the mechanism 200 and the drive wheels 128 and 129 also lock in place. The locked mechanism holds the lift plate 108 in an elevated position within the housing 104 after the actuator 152 elevates the lift plate 108 to the elevated position.

Figure 4:
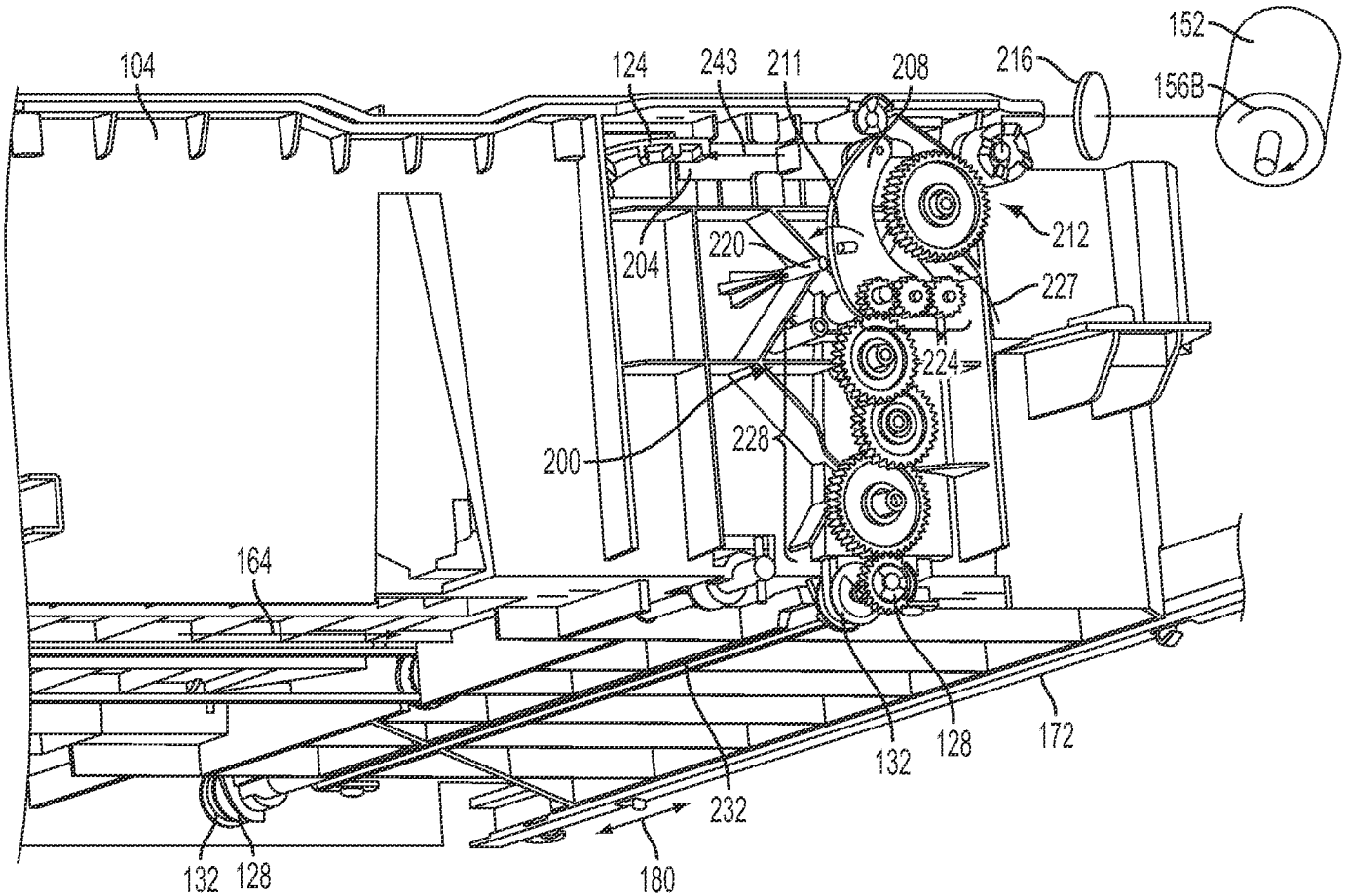
FIG. 4 is another perspective view of the exterior side of the tandem media supply of FIG. 1.

FIG. 4 depicts the mechanism 200 of FIG. 3 when the reserve media stack 112 engages the gate assembly 120 as depicted in FIG. 2. As shown in FIG. 2, FIG. 3, and FIG. 7, the feed stack gate 124 rotates in direction 728 when the leading edge 114 of the reserve media stack 112 slides past the reserve stack gate 122. The movement of the feed stack gate 124 slides the release linkage 204 in direction 242 and the pivoting release arm 208 pivots in direction 226. FIG. 4 depicts the transmission gears 224 after the transmission gears 224 move out of engagement with the drive gears 212. The gate assembly 120 and pivoting release arm 208 remain in the position depicted in FIG. 2, FIG. 4, and FIG. 8 as the reserve media stack moves in direction 164 onto the lift plate 108.

When the transmission gears 224 disengage from the drive gears 212 and one-way mechanical clutch 216, the transmission gears 224, intermediate gears 228, and drive wheels 128 and 129 rotate freely. Gravity pulls downward of the lift plate 108, and the lift plate 108 descends to the base of the housing 104 in direction 159. The belts 132 move with the lift plate 108, and the various gears in the mechanism 200 rotate as the lift plate 108 descends to the base of the housing 104. In some embodiments, the frictional resistance of the belts 132 and gears in the mechanism 200 regulates the rate of descent of the lift plate 108 to prevent the lift plate 108 from striking the base of the housing 104 with a force that could damage components in the media supply 100.

In one configuration of the media supply 100, the controller 190 operates the actuator 160 continuously to move the reserve media stack 112 toward the lift plate 108 after the sheet sensor 188 identifies that the first media sheet stack 110 has been exhausted. In this configuration, the lift plate drops from the elevated position to the base of the housing 104 with a sufficient speed so that the leading edge 114 of the reserve media sheet stack 112 moves over the lift plate 108 after the lift plate 108 has moved to the base of the housing 104. In another configuration, the controller 190 operates the actuator 160 to move the reserve media stack 112 to an intermediate position and deactivates the actuator 160 for a predetermined time. The leading edge of the media stack 112 engages the gate assembly 120 in the intermediate position, and the lift plate 108 descends to the base of the housing 104. The controller 190 activates the actuator 160 and moves the media stack 112 onto the lift plate 108. The controller 190 deactivates the actuator 160 to provide sufficient time for the lift plate 108 to descend to the base of the housing 104 in embodiments where the media stack 112 could engage the lift plate 108 prior to the lift plate 108 fully descending to the base of the housing 104.

The feed stack gate 124 and release linkage 204 maintain the position of the pivoting release arm 208 in the configuration of FIG. 4 until the second actuator 160 completely moves the reserve media stack 112 onto the lift plate 108. The reserve stack gate 122 and feed stack gate 124 subsequently return to the configuration of FIG. 1. In the media supply 100, a spring 125 biases the reserve stack gate 122 and feed stack gate 124 into the configuration of FIG. 1 after the reserve media stack 112 moves past the gate assembly 120. The release linkage 204 slides in direction 243 and the spring 220 biases the pivoting release arm 208 in direction 227 into engagement with the drive gear 212 as depicted in FIG. 3. The controller 190 subsequently operates the actuator 152 to elevate the lift plate 108 and reserve media stack 112 to the media feeder 144.

Figure 5:
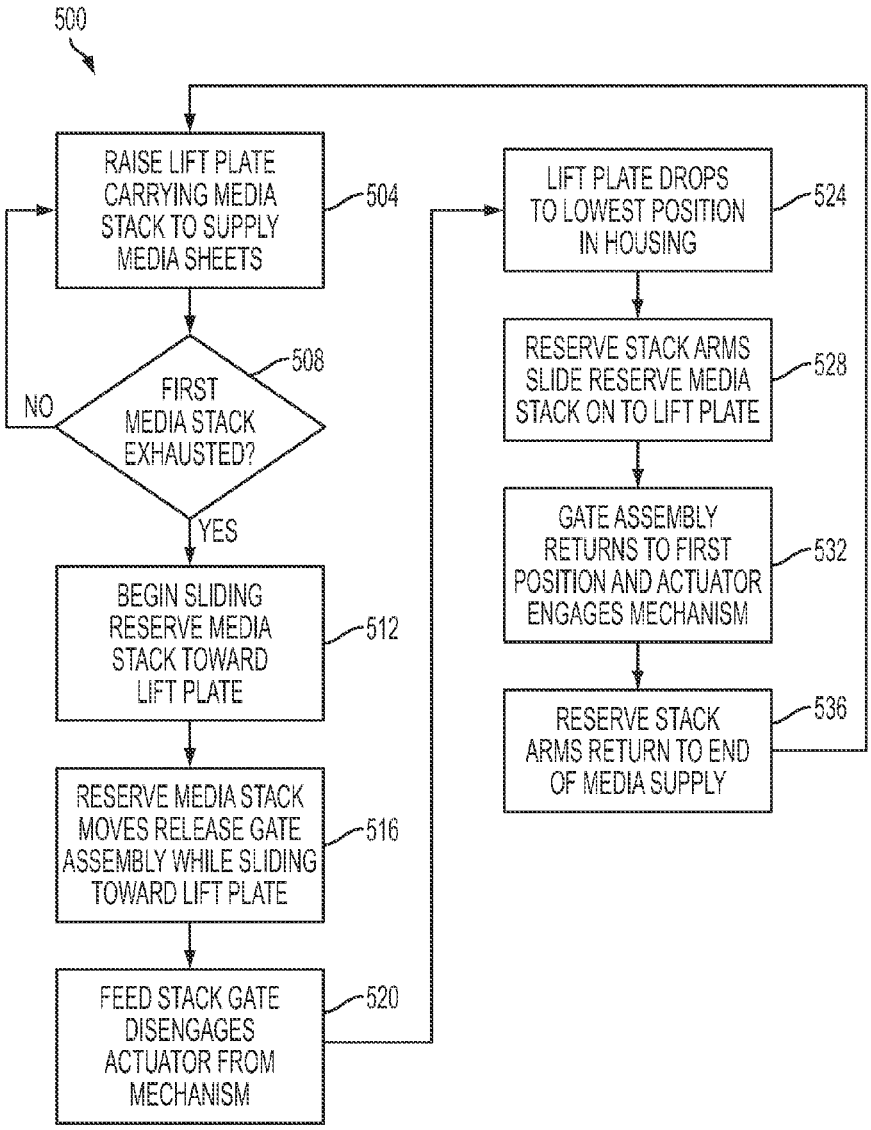
FIG. 5 is a block diagram of process for moving a reserve media stack onto a lift plate in a tandem media supply.

FIG. 5 depicts a process 500 for operating a tandem media supply 100. FIG. 5 is described in conjunction with the media supply 100 depicted in FIG. 1-FIG. 4 for illustrative purposes. In process 500, a lift plate in the media supply elevates to supply a top sheet in a vertical stack of media sheets to a media feeder (block 504) until the first stack of media sheets is exhausted (block 508). As depicted in FIG. 1, the actuator 152 elevates the lift plate 108 and operates the media feeder 140 to extract media sheets from the top of the vertical media stack 110.

Once the first stack of media sheets is exhausted, the reserve media stack slides towards the lift plate (block 512) and the reserve media stack moves the gate assembly while sliding toward the lift plate (block 516) to disengage the actuator from a mechanism (block 520). As depicted in FIG. 2, the actuator 160 slides the slideable arms 116 and reserve media stack 112 in direction 164. The reserve stack gate 122 and feed stack gate 124 rotate into the configuration depicted in FIG. 8, enabling the reserve media stack to continue sliding toward the lift plate 108. As depicted in FIG. 4, the pivoting release arm 208 disengages the transmission gears 224 in the mechanism 200 from the drive gears 212, one-way mechanical clutch 216, and the actuator 152.

After the actuator disengages from the mechanism, the lift plate drops to a lowest position in the housing (block 524) to enable the reserve media stack to slide onto the lift plate (block 528), and the gate assembly returns to the first position that engages the mechanism to the actuator (block 532). In the media supply 100, the lift plate 108 descends to the base of the housing 104 under a force of gravity after the mechanism 200 disengages, and the actuator 160 moves the reserve media stack 112 onto the lift plate 108. The gate spring 125 pulls on the feed stack gate 124 and returns the gate assembly 120 to the configuration of FIG. 1 after the reserve media stack 112 has completely moved onto the lift plate 108, and the mechanism 200 engages with the actuator 152 to enable the actuator 152 to elevate the lift plate 108 and reserve media stack 112. The gate sensor 126 generates a signal in response to the gate assembly 120 returning to the first position, and the signal from the gate sensor 126 indicates that the reserve media stack 112 is in position on the lift plate 108. Thereafter, the media supply 100 can begin feeding sheets from the reserve media stack 112, which is now a new feed media stack. The controller 190 reverses the direction of the actuator 160 to return the slideable arms 116 to the end of the housing 104 as depicted in FIG. 1 (block 536). After the slideable arms 116 return to the configuration of FIG. 1, an operator can insert a new reserve media sheet stack in the media supply 100.

Figure 6:
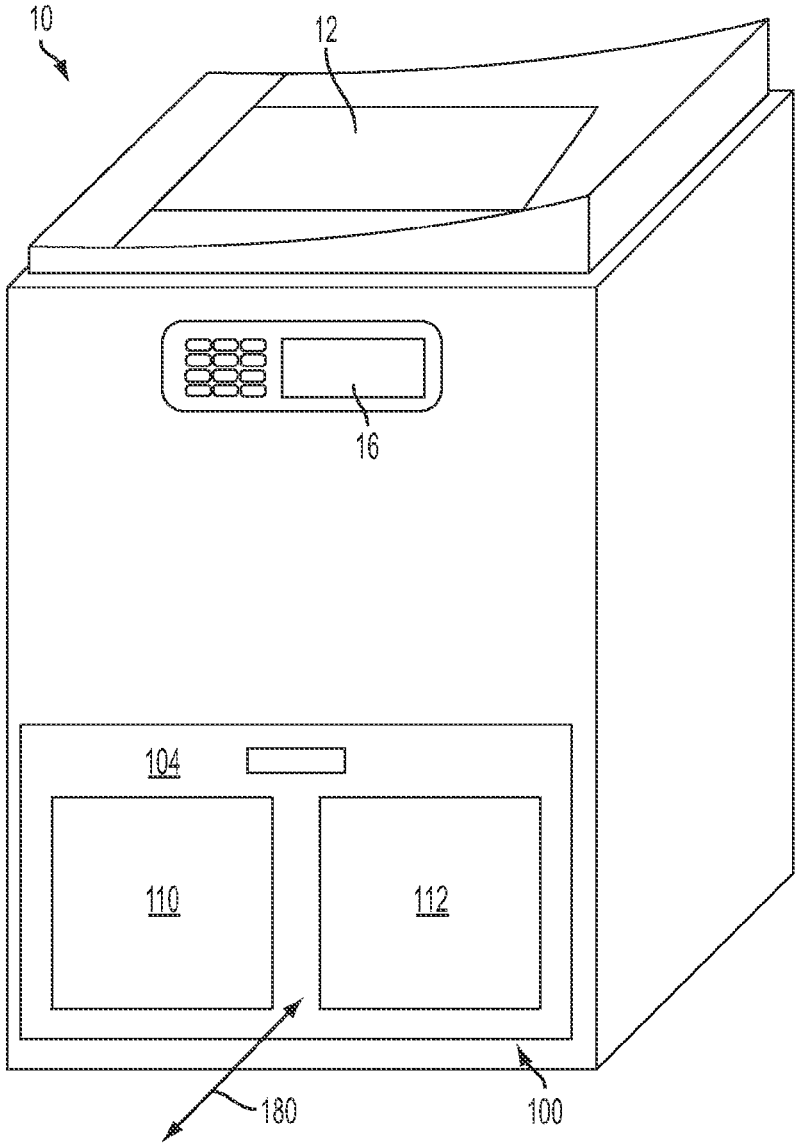
FIG. 6 is an exterior view of a printer that includes a tandem media supply.

FIG. 6 is an exterior view of an exemplary printer 10 that incorporates the media supply 100. During operation, the printer 10 extracts media sheets from the media stack 110 and subsequently from the media stack 112 after the media stack 110 is exhausted. The printer 10 prints images on the media sheets and the printed media sheets exit the printer 10 at an outlet tray 12. Various embodiments of the printer 10 use a xerographic or inkjet printing technique to print the images on the media sheets. A user interface 16 generates visual and/or audible alerts when the supply of media sheets in the media supply 100 is low or is exhausted. The user interface can also generate a paper jam error message or other alerts if the controller 190 identifies that the gate assembly 120 is displaced due to one or both of the media stacks being improperly loaded in the media supply 100. An operator can service the media supply 100 to ensure that the media sheet stacks 110 and 112 are properly aligned and that the correct sizes of paper are placed in the media supply 100 in response to the alert.

In the printer 10, the media supply 100 is a slideable drawer that opens and closes as depicted by arrows 180. In one embodiment, the media supply 100 slides on rails such as rails 172 shown in FIG. 1-FIG. 4. An operator slides the media supply drawer 100 outward from the printer 10 and places vertical stacks of media sheets on either or both of locations in the media supply that hold the tandem media stacks 110 and 112. The printer 10 resumes printing operations with the media sheets in the media supply 100 once the operator closes the media supply drawer 100.

The printer 10 is merely exemplary of one embodiment of a printer that incorporates the media supply 100. Various other printer and imaging device embodiments including photocopiers, faxes, multi-function devices and the like may incorporate the media supply 100. Some configurations additionally include multiple tandem media supplies with the configuration of the media supply 100.

Variants of the above-disclosed and other features and functions, or alternatives thereof, may be combined into many other different devices, applications or methods. Various presently unforeseen or unanticipated alternatives, modifications, variations or improvements therein may be subsequently made by those skilled in the art, which are also intended to be encompassed by the following claims.

We claim:

1. A tandem media sheet supply for an imaging device comprising:

a housing having a volume that is configured with a first portion and a second portion, each portion of the volume in the housing being configured to hold a vertical stack of media sheets in the housing;

a gate assembly located between the first portion and the second portion of the volume in the housing and comprising:

a first gate configured to engage a first vertical stack of media sheets in the first portion of the volume;

a second gate mechanically connected to rotate about the first gate, the first gate and second gate being configured to move between a first position and a second position; and a biasing member configured to bias the first gate and second gate into the first position; and an actuator configured to move the first vertical stack of media sheets from the first portion of the volume in the housing to the second portion of the volume in the housing, the movement of the first vertical stack of media sheets displacing and movably contacting the first gate and the second gate from the first position to the second position, the first gate and second gate in the second position enabling the first vertical stack of media sheets to move from the first portion of the volume in the housing to the second portion of the volume in the housing, the biasing member being configured to move the first gate and the second gate to the first position in response to the actuator moving the first vertical stack of media sheets to the second portion of the volume, and the second gate in the first position being configured to hold the first vertical stack of media sheets in the second portion of the volume.

2. The tandem media sheet supply of claim 1 further comprising:

a sensor operatively connected to the gate assembly and configured to generate a signal corresponding to a position of the first gate and the second gate;

a slideable member mechanically coupled to the actuator and positioned in the first portion of the volume to move the first vertical stack of media sheets from the first portion of the volume to the second portion of the volume in the housing; and

3. The tandem media sheet supply of claim 1 further comprising:

a lift plate configured to support a vertical stack of media sheets in the second portion of the volume in the housing and configured to elevate from a first lift position within the second portion of the volume in the housing to a second lift position within the second portion of the volume in the housing;

a second actuator;

a mechanism that operatively connects the second actuator to the lift plate, the second actuator being configured to operate the mechanism to elevate the lift plate and the mechanism being configured to hold the lift plate in the second lift position; and the gate assembly being further configured to disengage the lift plate from the mechanism when the first gate and second gate are in the second position to enable the lift plate to move from the second lift position to the first lift position within the second portion of the volume in the housing.

4. The tandem media sheet supply of claim 1, the biasing member being a spring.

* * * * *